US006892717B1

(12) United States Patent
Polanco et al.

(10) Patent No.: US 6,892,717 B1
(45) Date of Patent: May 17, 2005

(54) QUICK RELEASE ARROW HOLDER

(76) Inventors: Albert M. Polanco, 1008 W. Ohara Rd., Anthony, NM (US) 88021; Albert R. Polanco, 2071 Turrentine Dr., Las Cruces, NM (US) 88001; Cliff Macias, 30 Marissa La., Santa Fe, NM (US) 87508

( * ) Notice: Subject to any disclaimer, the term of this patent is extended or adjusted under 35 U.S.C. 154(b) by 0 days.

(21) Appl. No.: 10/410,248

(22) Filed: Apr. 9, 2003

Related U.S. Application Data

(60) Provisional application No. 60/371,319, filed on Apr. 9, 2002.

(51) Int. Cl.[7] ..... F41B 5/22

(52) U.S. Cl. ..... 124/44.5; 24/130; 24/457; 24/459; 24/545; 248/519

(58) Field of Search ..... 24/3.1, 3.12, 130, 24/457, 459, 530, 545, 546, 547; 248/80, 110, 519, 534, 538, 49, 60, 683; 124/24.1, 44.5, 25.5, 25.7; 224/916

(56) References Cited

U.S. PATENT DOCUMENTS

| | | | | | |
|---|---|---|---|---|---|
| 268,407 | A | * | 12/1882 | Hughes | 606/203 |
| 1,515,418 | A | * | 11/1924 | Smith | 24/130 |
| 1,538,705 | A | * | 5/1925 | Kennedy et al. | 24/31 F |
| 2,909,167 | A | * | 10/1959 | Fredrickson | 124/25.7 |
| 3,159,372 | A | * | 12/1964 | Mcintosh | 248/683 |
| 3,244,161 | A | * | 4/1966 | Jenson | 124/24.1 |
| 3,760,788 | A | * | 9/1973 | Hartman | 124/44.5 |
| 4,118,838 | A | * | 10/1978 | Schiefer et al. | 24/115 R |
| 4,617,775 | A | * | 10/1986 | Padrun | 52/684 |
| 4,823,764 | A | * | 4/1989 | Knaack | 124/88 |
| 5,095,883 | A | * | 3/1992 | Kurtz | 124/25 |
| 5,108,054 | A | * | 4/1992 | Degand | 248/50 |
| 5,259,359 | A | * | 11/1993 | Meredith | 124/25.5 |
| 5,265,584 | A | * | 11/1993 | Judson et al. | 124/86 |
| 5,331,725 | A | * | 7/1994 | Chou | 24/545 |
| 5,369,835 | A | * | 12/1994 | Clarke | 15/167.1 |
| 5,425,518 | A | * | 6/1995 | Czerniak | 248/67.5 |
| 6,056,253 | A | * | 5/2000 | Tripp | 248/213.2 |

* cited by examiner

*Primary Examiner*—John A. Ricci
(74) *Attorney, Agent, or Firm*—Alberto A. Leon, Esquire; Bauman, Dow & Leon, P.C.

(57) ABSTRACT

The present invention relates to an improved arrow holder that facilitates the arrow/bow combination user's ability to carry a nocked arrow safely on the bow by pre-positioning the arrow for a quicker shot while keeping the arrow safely away from the user's body. The device of this invention comprises a single piece device made of neoprene rubber or other adequate material with a self-adhesive backing. The device of this invention not only permits the hunter to carry the arrow safely, in a semi-cocked position, but is also permits the hunter to get full draw on the bow in three (3) short, simple and efficient steps. The hunter requires less movement to operate the bow/arrow combination while never losing eye contact with his or her target.

6 Claims, 4 Drawing Sheets

QUICK RELEASE ARROW HOLDER

CROSS-REFERENCE TO RELATED APPLICATION

I hereby claim the benefit under Title 35, United States Code Section 119(e) of any United States Provisional Application(s) listed below:
Application No. 60/371,319
Filing Date: Apr. 9, 2002

BACKGROUND OF THE INVENTION

1. Technical Field of the Invention

Archery bows, archery arrows, arrow vests, arrow holders.

2. Description of the Background Art

Using a bow and arrow for the purposes of hunting has become an increasingly popular way of practicing the sport. This form of hunting poses a much greater challenge than other modern available methods. The common method of operation of a bow and arrow combination requires drawing an arrow back by looping the forefinger over the arrow to lock the arrow against the bow. The user then withdraws the finger immediately before releasing the arrow.

The usual method of operating a bow/arrow combination has several inherent problems. In order to improve accuracy by allowing a flatter trajectory, modern arrows are shorter and lighter than they used to be. Unfortunately, the decrease in length and weight of the arrow, increases the chances of accidental slips during release which could injure the user. Another problem is that the archer-hunter must always be ready to launch an arrow upon encountering game. To remain in a ready state, the hunter then must keep his or her finger wrapped around the arrow to hold it against the bow arrow rest. Obviously this requirement can cause a lot of discomfort to the user which could result in an accidental release. The consequences of such event include potential injury to the user and startling of the game.

The invention disclosed herein solves the problems set forth above by placing a force against the arrow to lock it against the bow until game is sighted. In addition, the invention allows the archer-hunter to safely carry a nocked arrow while looking for, or pursuing, game. Further, by using the device disclosed herein, the archer-hunter will be able to avoid hitting rocks or brush while keeping the arrow away from his or her body. Even further, the user of the invention disclosed herein will be able to shoot an arrow in a much more efficient and manner than a user of a traditional system.

Most users of traditional bow/arrow combinations carry all their arrows in an arrow quiver attached to the bow. If the archer-hunter happens to jump a target on the way to his or her stand or blind, he or she must take the following eight steps: (1) Pull the arrow from the quiver; (2) bring the arrow around to the outside of the bow; (3) place the arrow on the arrow rest; (4) look a the arrow in order to get the feathers and/or vanes positioned; (5) nock the arrow; (6) relocate the target; (7) estimate the distance; and (8) shoot the target with the bow ready at full draw.

SUMMARY OF THE INVENTION

The invention disclosed herein comprises a single piece device made of neoprene or santoprene rubbers or other adequate material which can be placed on a hunting bow, usually within 30 to 35 degrees from the arrow rest. The present invention allows the user to safely carry a nocked arrow on the bow. The device of this invention also comprises a self-adhesive backing such as 300LSE Hi Strength Adhesive or any other adhesive material which would interact properly with the device itself and with the bow being used. The invention's user can draw the bow in three (3) short and simple steps as follows: (1) Pull arrow from the Quick Release Arrow Holder and place it on the arrow rest on the bow; (2) estimate the distance to the Target; and (3) shoot target with bow ready at full draw.

An object of the invention is to facilitate the user of a hunting bow/arrow system to carry a nocked arrow safety on the bow by pre-positioning the arrow for a quicker shot, while keeping the arrow away from the user's body.

Another object of the invention is to shorten the number of steps necessary to shoot a target with an arrow, thus increasing the probability of a successful shot.

A further object of the invention is to provide an archer-hunter with a system to safely carry an arrow in a semi-cocked position, while avoiding rocks, trees, brush, or other obstacles usually encountered in hunting areas.

A still further object of the invention is to minimize potential injuries which can be caused by modem bow/arrow systems, which use lighter and shorter arrows while allowing a more efficient and less noisy way of enjoying the bow/arrow hunting experience.

BRIEF DESCRIPTION OF THE DRAWINGS

Figure No. 1: shows a top view of the arrow holder of the invention (top rounded arrow holder groove and top of circular base) including relative dimensions and a top view showing the actual size of the preferred embodiment of the invention.

Figure No. 2: illustrates a front view of the arrow holder of the invention, looking at the actual elevation of the arrow holder groove and side of circular base with adhesive at the bottom of the base, including relative dimensions and a front view showing the actual size of the preferred embodiment of the invention.

Figure 1:
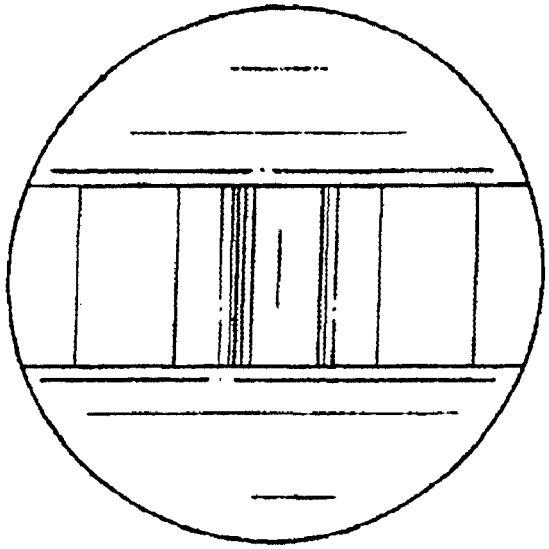
Figure 2:
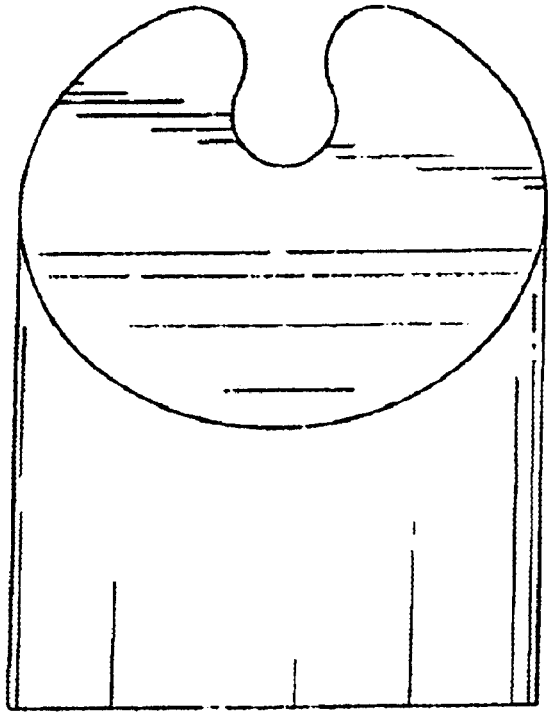
Figure 3:
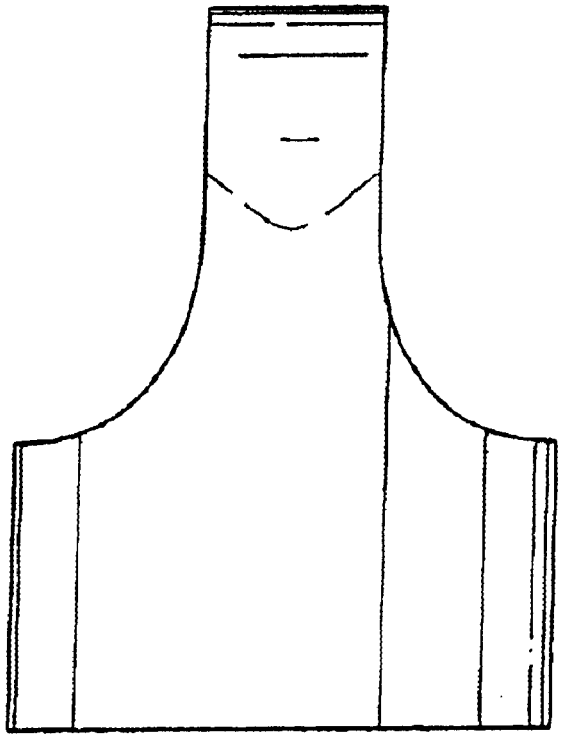
Figure 4:
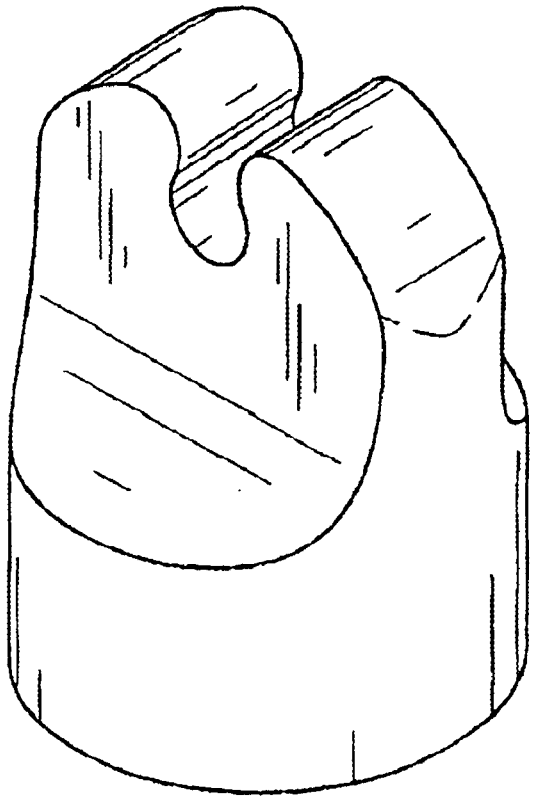

Figure No. 3: shows a side view of the arrow holder of this invention, looking at the side elevation of the curving top for the arrow holder groove and the side of the circular base with adhesive at the bottom of the base, including relative dimensions and a side view showing the actual size of the preferred embodiment of the invention.

Figure No. 4: illustrates an isometric view of the arrow holder of the invention.

What is claimed is:

1. A single piece arrow holder which simplifies the drawing of an archery bow, said arrow holder comprising:

(a) a curving top side and a circular flat base side, said curving top side further comprising a top rounded arrow holder groove and said circular flat base side further comprising a circular base;

(b) a cylindrical portion located between the curving top side and the circular flat base side; and (c) a self-adhesive backing means to attach the arrow holder's circular base to an archery bow.

2. A single piece arrow holder according to claim 1 wherein the arrow holder is made out of neoprene rubber.

3. A single piece arrow holder according to claim 1 wherein the arrow holder is made out of santoprene rubber.

4. A single piece arrow holder according to claim 1 wherein the arrow holder is placed on the archery bow within 30 to 35 degrees from an arrow rest engaged to the archery bow, said arrow rest being capable of receiving an arrow, so a user can safely carry a nocked arrow on the bow in a semi-cocked position by pre-positioning the arrow for a quicker shot while keeping the arrow away from the user's body and at the same time getting full draw on the bow.

5. A single piece arrow holder according to claim 1 wherein the self-adhesive backing means is 300LSE Hi Strength adhesive.

6. A single piece arrow holder according to claim 1 wherein the self-adhesive backing means is a commercially available adhesive comprising a peelable protective cover.

* * * * *